US006695065B2

(12) United States Patent
Simpson et al.

(10) Patent No.: US 6,695,065 B2
(45) Date of Patent: Feb. 24, 2004

(54) TUBING EXPANSION

(75) Inventors: Neil Andrew Abercrombie Simpson, Aberdeen (GB); David H. Grant, Ellon (GB); Grant Adams, Aberdeen (GB)

(73) Assignee: Weatherford/Lamb, Inc., Houston, TX (US)

( * ) Notice: Subject to any disclaimer, the term of this patent is extended or adjusted under 35 U.S.C. 154(b) by 0 days.

(21) Appl. No.: 10/175,544

(22) Filed: Jun. 19, 2002

(65) Prior Publication Data

US 2003/0051885 A1 Mar. 20, 2003

(30) Foreign Application Priority Data

Jun. 19, 2001 (GB) ..... 0114872

(51) Int. Cl.[7] ..... E21B 19/00

(52) U.S. Cl. ..... 166/384; 166/55.8; 166/55.1; 166/117.6; 166/206; 166/217; 72/297

(58) Field of Search ..... 166/55.1, 55.8, 166/117.6, 206, 208, 212, 217, 380, 382, 384; 72/148, 150, 297

(56) References Cited

U.S. PATENT DOCUMENTS

| | | | | |
|---|---|---|---|---|
| 761,518 | A | 5/1904 | Lykken | |
| 1,324,303 | A | 12/1919 | Carmichael | |
| 1,545,039 | A | 7/1925 | Deavers | |
| 1,561,418 | A | 11/1925 | Duda | |
| 1,569,729 | A | 1/1926 | Duda | |
| 1,597,212 | A | 8/1926 | Spengler | |
| 1,930,825 | A | 10/1933 | Raymond | |
| 1,981,525 | A | 11/1934 | Price | |
| 2,153,883 | A | 4/1939 | Foster et al. | 255/27 |
| 2,214,226 | A | 9/1940 | English | |
| 2,216,226 | A | 10/1940 | Bumpous | 36/44 |
| 2,383,214 | A | 8/1945 | Prout | 153/82 |
| 2,499,630 | A | 3/1950 | Clark | 153/81 |
| 2,627,891 | A | 2/1953 | Clark | 153/82 |
| 2,663,073 | A | 12/1953 | Bieber et al. | 29/148 |

(List continued on next page.)

FOREIGN PATENT DOCUMENTS

| | | | |
|---|---|---|---|
| EP | 0 961 007 | 12/1999 | E21B/33/10 |
| GB | 887150 | 1/1962 | |
| GB | 1 448 304 | 9/1976 | E21B/33/13 |
| GB | 2 216 926 | 10/1989 | E21B/7/20 |
| GB | 2 320 734 | 7/1998 | E21B/33/127 |
| GB | 2 329 918 | 4/1999 | E21B/43/10 |
| WO | WO 93/24728 | 12/1993 | E21B/17/10 |
| WO | WO 97/20130 | 6/1997 | E21B/43/10 |
| WO | WO 99/18328 | 4/1999 | E21B/23/01 |
| WO | WO 99/23354 | 5/1999 | E21B/43/10 |
| WO | WO 00/37773 | 6/2000 | E21B/43/10 |
| WO | WO 01/60545 | 8/2001 | B21D/39/00 |

OTHER PUBLICATIONS

British Search Report dated Oct. 24, 2001, for application No. GB0114872.5.

Partial International Search Report dated Oct. 23, 2002, for application No. PCT/GB02/02797.

*Primary Examiner*—Roger Schoeppel

(74) *Attorney, Agent, or Firm*—Moser, Patterson & Sheridan, L.L.P.

(57) ABSTRACT

A method of expanding tubing comprises the steps: providing a length of expandable tubing; locating an expansion tool, such as a cone, in the tubing; and applying impulses to the tool to drive the tool through the tubing and expand the tubing to a larger diameter. The tubing may be located downhole and may have a solid wall or a slotted wall.

54 Claims, 2 Drawing Sheets

U.S. PATENT DOCUMENTS

| | | | | |
|---|---|---|---|---|
| 2,898,971 | A | 9/1959 | Hempel | 153/82 |
| 3,087,546 | A | 4/1963 | Wooley | |
| 3,191,677 | A | 6/1965 | Kinley | |
| 3,195,646 | A | 7/1965 | Brown | 166/208 |
| 3,424,244 | A | 1/1969 | Kinley | 155/114 |
| 3,467,180 | A | 9/1969 | Pensotti | 165/180 |
| 3,528,498 | A | 9/1970 | Carothers | 166/55 |
| 3,616,868 | A | 11/1971 | Bassinger | 175/92 |
| 3,712,376 | A | 1/1973 | Owen et al. | 166/277 |
| 3,776,307 | A | 12/1973 | Young | 166/125 |
| 3,818,734 | A | 6/1974 | Bateman | 72/75 |
| 3,911,707 | A | 10/1975 | Minakov et al. | 72/76 |
| 3,948,321 | A | 4/1976 | Owen et al. | 166/277 |
| 4,069,573 | A | 1/1978 | Rogers, Jr. et al. | 29/421 R |
| 4,127,168 | A | 11/1978 | Hanson et al. | 166/123 |
| 4,159,564 | A | 7/1979 | Cooper, Jr. | 29/727 |
| 4,288,082 | A | 9/1981 | Setterberg, Jr. | 277/125 |
| 4,319,393 | A | 3/1982 | Pogonowski | 29/434 |
| 4,324,407 | A | 4/1982 | Upham et al. | 277/27 |
| 4,429,620 | A | 2/1984 | Burkhardt et al. | 91/395 |
| 4,508,174 | A | 4/1985 | Skinner et al. | 166/373 |
| 4,531,581 | A | 7/1985 | Pringle et al. | 166/120 |
| 4,588,030 | A | 5/1986 | Blizzard | 166/120 |
| 4,697,640 | A | 10/1987 | Szarka | 166/120 |
| 4,848,469 | A | 7/1989 | Baugh et al. | 166/382 |
| 4,890,682 | A | 1/1990 | Worrall et al. | 175/61 |
| 5,052,483 | A | 10/1991 | Hudson | 166/55 |
| 5,086,853 | A | 2/1992 | Evans | 175/297 |
| 5,271,472 | A | 12/1993 | Leturno | 175/107 |
| 5,348,095 | A | 9/1994 | Worrall et al. | 166/380 |
| 5,409,059 | A | 4/1995 | McHardy | 166/208 |
| 5,435,400 | A | 7/1995 | Smith | 175/61 |
| 5,472,057 | A | 12/1995 | Winfree | 175/57 |
| 5,520,255 | A | 5/1996 | Barr et al. | 175/24 |
| 5,553,679 | A | 9/1996 | Thorp | 175/73 |
| 5,560,426 | A | 10/1996 | Trahan et al. | 166/120 |
| 5,685,369 | A | 11/1997 | Ellis et al. | 166/195 |
| 5,706,905 | A | 1/1998 | Barr | 175/61 |
| 5,901,787 | A | 5/1999 | Boyle | 166/135 |
| 6,021,850 | A | 2/2000 | Wood et al. | 166/380 |
| 6,029,748 | A | 2/2000 | Forsyth et al. | 166/380 |
| 6,098,717 | A | 8/2000 | Bailey et al. | 166/382 |
| 6,112,818 | A | 9/2000 | Campbell | 166/384 |
| 6,325,148 | B1 | 12/2001 | Trahan et al. | 166/297 |
| 6,425,444 | B1 | 7/2002 | Metcalfe et al. | 166/387 |
| 6,446,323 | B1 | 9/2002 | Metcalfe et al. | 29/523 |
| 6,543,552 | B1 | 4/2003 | Metcalfe et al. | |
| 6,543,553 | B2 * | 4/2003 | Bergeron | 175/61 |
| 6,585,053 | B2 * | 7/2003 | Coon | 166/387 |
| 6,591,905 | B2 * | 7/2003 | Coon | 166/117.6 |
| 6,598,678 | B1 * | 7/2003 | Simpson et al. | 166/297 |
| 2001/0040054 | A1 | 11/2001 | Haugen et al. | 175/61 |
| 2001/0045284 | A1 | 11/2001 | Simpson | 166/313 |
| 2002/0145281 | A1 | 10/2002 | Metcalfe et al. | 285/206 |
| 2002/0166668 | A1 | 11/2002 | Metcalfe et al. | 166/378 |
| 2003/0037931 | A1 | 2/2003 | Coon | |
| 2003/0042022 | A1 | 3/2003 | Lauritzen et al. | |
| 2003/0047322 | A1 | 3/2003 | Maguire et al. | |

* cited by examiner

TUBING EXPANSION

FIELD OF THE INVENTION

This invention relates to tubing expansion, and in particular to an expansion tool and method for expanding tubing downhole.

BACKGROUND OF THE INVENTION

The oil and gas exploration and production industry is making increasing use of expandable tubing for use as, for example, casing and liner, in straddles, and as a support for expandable sand screens. The tubing may be slotted, such as the tubing and sand screens sold under the EST and ESS trade marks by the applicant, or may have a solid wall. Various forms of expansion tools have been utilised, including expansion cones and mandrels which are pushed or pulled through tubing by mechanical or hydraulic forces. However, these methods typically require transfer of significant forces from surface, and furthermore there are difficulties associated with use of hydraulic forces in the expansion of slotted tubing; the presence of the slots in the unexpanded tubing prevents the use of hydraulic force to drive the cone or mandrel through the tube. A number of the difficulties associated with expansion cones and mandrels may be avoided by use of rotary expansion tools, which feature radially extending rollers which are urged outwardly into rolling contact with the tubing to be expanded while the tool is rotated and advanced through the tubing. However, it has been found that the torques induced by such rotating tools may induce twisting in the expandable tubing, particularly in slotted tubing.

It is among the objectives of embodiments of the present invention to provide an expansion method and apparatus which obviates or mitigates these difficulties.

SUMMARY OF THE INVENTION

According to one aspect of the present invention there is provided a method of expanding tubing, the method comprising the steps:

- providing a length of expandable tubing of a first diameter;
- locating an expansion tool in the tubing;
- applying a plurality of impulses to the tool to drive the tool through the tubing and expand the tubing to a larger second diameter.

According to a further aspect of the present invention there is provided tubing expansion apparatus comprising:

- an expansion tool for advancement through a length of expandable tubing to expand the tubing from a smaller first diameter to a larger second diameter; and
- means for transmitting a tubing-expanding impulse to the tool.

Preferably, the expansion operation is carried out downhole.

The impulses may be provided by any appropriate means and thus the invention provides a flexibility in the range of apparatus and supports that may be utilised to expand tubing downhole. The impulses may be produced hydraulically, for example by pumping fluid through a valve or other variable flow restriction, such that the variation in flow through the restriction induces a variation in fluid pressure. The resulting varying fluid pressure may act directly on the expansion tool, or indirectly via a shock sub or the like. One embodiment of the invention may involve the combination of a conventional hydraulic hammer with an expansion cone provided with an anvil or other arrangement for cooperating with the hammer, possibly also in combination with an appropriate number of weight subs. Alternatively, or in addition, a reciprocating or otherwise movable mass may be utilised, the mass reciprocating in response to a controlled varying flow of hydraulic fluid, and impacting on the expansion tool, typically via an anvil. It is preferred that the impulse force is created adjacent the expansion tool, to limit attenuation. As such arrangements would not require a fluid seal between the expansion tool, typically in the form of an expansion cone, and the tubing, these embodiments of the invention permit expansion of slotted tubing by means of hydraulically-actuated apparatus. Furthermore, the use of hydraulic pressure to induce or create impulses or impacts will tend to allow expansion of tubing utilising lower pressures than are required to drive an expansion cone through tubing using conventional methods; the apparatus utilised may therefore be rated for operation at lower pressures, and be less complex and expensive.

Other embodiments may utilise mechanical actuation, for example a rotating shaft may be linked to the expansion tool via an appropriate cam profile. In a preferred embodiment, a rotating shaft is coupled to a reciprocating mass via a cam arrangement, such that rotation of the shaft causes the mass to impact on the expansion tool. The mass may be spring-mounted, the spring tending to bias the mass towards the tool. The mass may be restrained against rotation relative to the shaft, and may be splined or otherwise coupled to the tool. Rotation of the shaft may be achieved by any appropriate means, for example from a top drive or kelly drive on surface, by a positive displacement motor (PDM) or other form of downhole hydraulic motor, or by a downhole electric motor.

Alternatively, electrical or magnetic actuation may be utilised, for example a magnetic pulsing field may be produced to induce reciprocal movement of a magnetic mass which impacts on the expansion tool, or a piezo-ceramic stack or magneto-strictive materials may be provided which expand or contract in response to applied electrical potentials.

As the expansion tool is not simply being pushed or pulled through the tubing by a substantially constant elevated force applied via the tool support, the tool support may not necessarily have to be capable of transmitting a compression or tension force of similar order to the force applied to the tool to achieve expansion. This facilitates use of lighter, reelable supports, such as coil tubing, and may permit use of a downhole tractor to advance the expansion tool through the tubing.

The expansion tool may be provided in combination with a further expansion tool, and in particular a further expansion tool which utilises a different expansion mechanism. In one embodiment, a rolling element expansion tool may be provided above an expansion cone to which impulses or impacts are applied, the leading expansion cone providing an initial degree of expansion and the following rolling element expansion tool providing a further degree of expansion. If the rolling element expansion tool is provided with one or more radially movable rolling elements, such an arrangement offers the advantage that the expansion tools are easier to pull back out; the tubing will have been expanded to a larger diameter than the normally fixed diameter expansion cone.

Where the expansion tool is in the form of an expansion cone, the cone angle may be selected such that advancement of the cone through the tubing is retained. Where the cone angle is steeper, the tendency for the tubing to elastically contract between impacts may be sufficient to overcome any residual applied force or weight, and the friction between the cone and the tubing, thus pushing the cone back. However, such difficulties may be overcome by appropriate selection of cone angle or by application of weight or provision of a ratchet or slip arrangement.

The impulses are preferably applied to the expansion tool with a frequency of at least one cycle per second, and most preferably with a frequency between 10 and 50 Hz. If desired or appropriate higher frequencies may be utilised, and indeed in certain applications ultrasonic frequencies may be appropriate.

In existing downhole applications, where any significant length of tubing is to be expanded, it is convenient for the expansion tool to advance through the bore at a rate of approximately 10 feet (3 meters) per minute. For this rate of advancement, the frequency of the impulses or impacts applied to the tool are preferably in the region of 20 Hz, as this equates to a distance of travel of the tool of around 2.5 mm per impact. For any significantly slower frequencies, the travel of the tool per impact required to obtain the preferred rate of advancement becomes difficult to achieve.

The apparatus preferably defines a throughbore to permit fluid communication through the apparatus, and to permit tools and devices, such as fishing tools or cement plugs, to be passed through the apparatus.

In embodiments of the invention utilised to expand solid-walled or otherwise fluid-tight tubing, the impulse expansion mechanism may be assisted by applying elevated fluid pressure to the interior of the tubing in the region of the expansion tool, as described in our co-pending PCT patent application PCT/GB01/04958, the disclosure of which is incorporated herein by reference. In such embodiments, the fluid pressure force may provide a tubing expansion force approaching the yield strength of the tubing, such that the additional expansion force supplied by the expansion tool and necessary to induce yield and allow expansion of the tubing is relatively low. The elevated pressure may be present at a substantially constant level, or may be provided in the form of pulses, timed to coincide with the impulses to the expansion tool.

According to a still further aspect of the present invention there is provided tubing expansion apparatus, the apparatus comprising:

an expansion device for advancement through a length of expandable tubing to expand the tubing from a smaller first diameter to a larger second diameter, the device being adapted to cycle between a smaller diameter first configuration and a larger diameter second configuration;

means for cycling the device between said configurations; and means for advancing the cycling means through the tubing.

The device may comprise a hollow flexible body, the dimensions of the body being variable in response to variations in internal fluid pressure. Preferably, the body is elastomeric. The body may carry rigid members for contact with an internal surface of the tubing.

According to a yet further aspect of the present invention there is provided a method of expanding tubing, the method comprising: providing a length of expandable tubing of a first diameter;

locating an expansion device in the tubing;

cycling the expansion device between a smaller diameter first configuration and a larger diameter second configuration using a cycling device, in said second configuration the expansion device describing a greater diameter than said tubing first diameter such that the tubing is expanded to a greater second diameter; and advancing the cycling device through the tubing.

Preferably, the device is cycled at least once a second.

BRIEF DESCRIPTION OF THE DRAWINGS

These and other aspects of the present invention will now be described, by way of example, with reference to the accompanying drawings, in which.

DETAILED DESCRIPTION OF THE DRAWINGS

Figure 1:
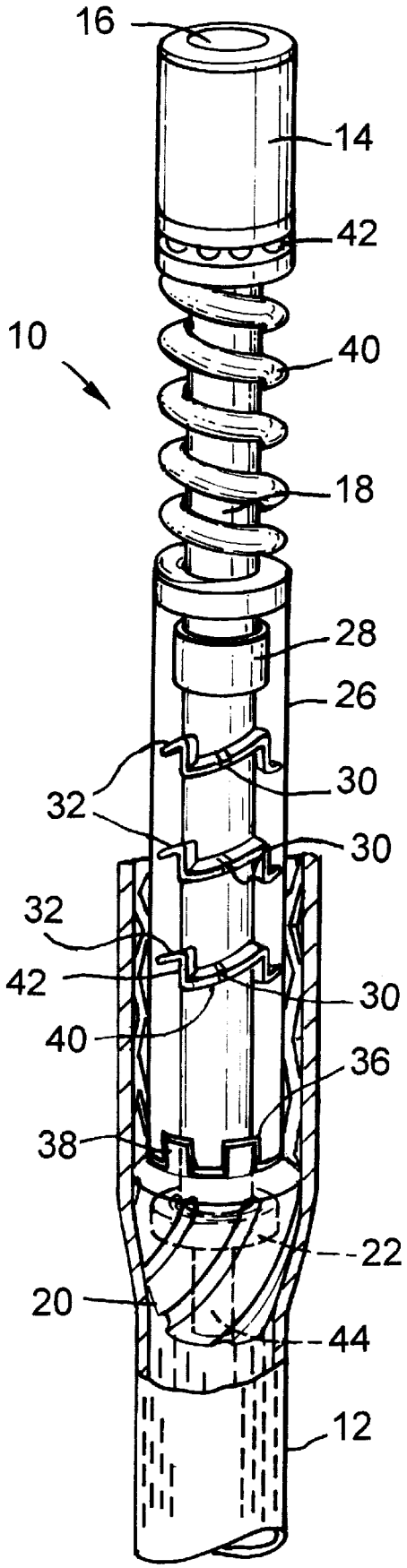
FIG. 1 is a part-sectional view of tubing expansion apparatus in accordance with a first embodiment of the present invention.

FIG. 1 of the drawings illustrates tubing expansion apparatus 10 being utilised to expand an expandable sand screen 12 downhole. The screen 12 comprises a metal mesh sandwiched between two slotted metal tubes, and is sold by the applicant under the ESS trade mark. The apparatus 10 is adapted to be mounted on the lower end of a suitable support, which may be in the form of a string of drill pipe.

The upper end of the apparatus 10 features a drive sub 14 provided with an appropriate top connection 16 for coupling to the lower end of the drill pipe, as noted above. A shaft 18 is coupled to the lower end of the drive sub 14, the lower end of the shaft 18 providing mounting for an expansion cone 20, via an appropriate thrust and radial bearing 22. Mounted around the shaft 18 is a reciprocating mass 26, with a sliding radial bearing 28 being provided between the mass 26 and the shaft 18. In addition, three drive dogs 30 extend radially from the shaft to engage respective wave-form cam grooves 32 provided in the inner face of the annular mass 26. Each groove 32 extends 360° around the inner face of the mass 26.

The lower end of the mass 26 features castellations 36 which engage with corresponding castellations 38 on an anvil defined by the upper face of the expansion cone 20. The castellations 36, 38 prevent relative rotational movement between the mass 26 and the cone 20, but permit a degree of relative axial movement therebetween, as will be described.

Mounted around the shaft 18 and engaging the upper end of the mass 26 is a mass return spring 40, a thrust bearing 42 being provided between the upper end of the spring 40 and the drive sub 14.

The apparatus 10 defines a through bore 44 allowing fluids and other devices to pass through the apparatus 10. Thus the apparatus 10 does not have to be removed from the bore to allow, for example, a cementing operation to be carried out.

In use, the apparatus 10 is mounted on a suitable support which, as noted above, may take the form of a string of drill pipe. The apparatus 10 is then run into the bore to engage the upper end of the unexpanded sandscreen 12. The sandscreen 12 may have been installed in the bore previously, or may be run in with the apparatus 10 when provided in combination with appropriate running apparatus.

With the cone 20 engaging the upper end of the sandscreen 12, the support string is then rotated at a speed of between 500 and 600 RPM, such that the shaft 18 also rotates. The cone 20 is prevented from rotating by the friction between the outer face of the cone 20 and the inner surface of the sandscreen 12. Due to the inter-engagement of the castellations 36, 38, the mass 26 is also prevented from rotating. However, due to the interaction between the drive dogs 30 and the respective cam grooves 32, the mass 26 is forced to reciprocate, as described below.

The grooves 32 define a wave form, including an inclined portion 40 and a substantially vertical portion 42, such that as the dogs 30 move along the respective inclined portions 40, the mass 26 is moved upwards, against the action of the spring 40. On the dogs 30 reaching the bottom ends of the substantially vertical groove portions 42, the spring 40 moves the mass 26 downwards, to impact on the upper face of the cone 20. The grooves 32 are arranged to provide four such impacts per rotation, such that rotating the shaft 18 at between 500 and 600 RPM causes the mass to reciprocate at a frequency between 2000 and 2400 cycles per minute (33 to 40 Hz).

The resulting impacts on the cone 20 drive the cone 20 downwardly through the sandscreen 12 in small steps, typically of around 1.25 to 1.5 mm (to give an average cone advancement rate of around 3 meters per minute), expanding the sandscreen 12 from its initial first diameter to a larger second diameter.

The use of impacts or impulses to drive the cone 20 through the tubing 12 tends to reduce the weight which must be applied to the apparatus 10 to drive the cone 20 through the tubing 12, when compared to a conventional cone expansion apparatus. This provides greater flexibility in the choice of support string for the apparatus 10, and the manner of applying force or weight to the cone 20. In the above-described embodiment, reference is made to a supporting string of drill pipe being rotated from surface. However, in other embodiments of the present invention the apparatus 10 may be mounted on a reelable support, such as coil tubing. In such an embodiment, rotation may be provided by a suitable downhole motor, such as a positive displacement motor (PDM) or an electric motor. Furthermore, the apparatus may also be provided in combination with a tractor, to provide motive force for the apparatus.

In the above-described embodiment the expansion cone 20 provides all of the expansion effect, however in alternative embodiments an expansion cone may be provided in combination with a further expansion tool, for producing further expansion of the sandscreen 12. For example, a rolling element expansion tool may be provided to follow the expansion cone.

Figure 2:
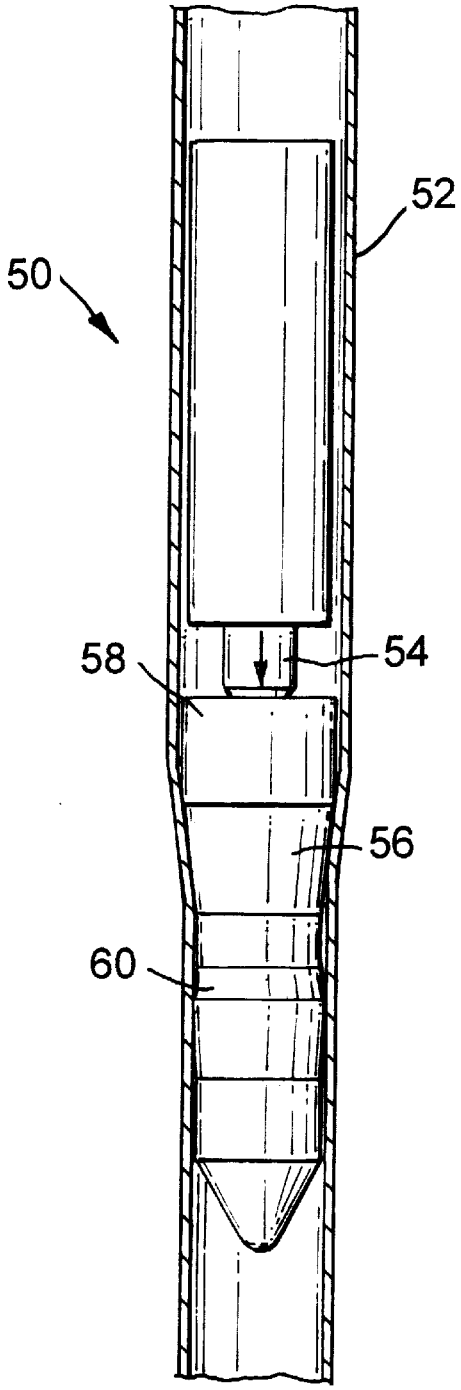
FIG. 2 is a schematic illustration of tubing expansion apparatus in accordance with a second embodiment of the present invention.

Reference is now made to FIG. 2 of the drawings, which is a schematic illustration of tubing expansion apparatus 50 in accordance with a second embodiment of the present invention, located in expandable solid-walled casing 52. The apparatus 50 comprises an impact hammer 54 which provides impulses to an expansion cone 56 provided with an anvil 58, and which operates to provide expansion in a substantially similar manner to the first-described embodiment. However, the apparatus 50 is adapted to allow provision of an additional hydraulic expansion force, as will be described.

The leading end of the apparatus 50 includes a seal 60 adapted to provide a sliding fluid-tight seal with the inner surface of the unexpanded casing 52, ahead of the cone 56. Thus, the volume of fluid above the seal 60, in which the expansion cone 56 is located, may be pressurised to create an additional expansion force. The hydraulic expansion force may be selected to provide an expansion force approaching the yield strength of the casing 52, such that the additional expansion force supplied by the expansion cone 56 and which is necessary to induce yield and allow expansion of the casing 52, is relatively low. In practice however, the hydraulic pressure force and the expansion force provided by the cone 56 will be determined taking account of local conditions, including the physical properties of the casing to be expanded, the pressure rating of the casing connectors, and the capabilities of the seals and pumps.

Figure 3:
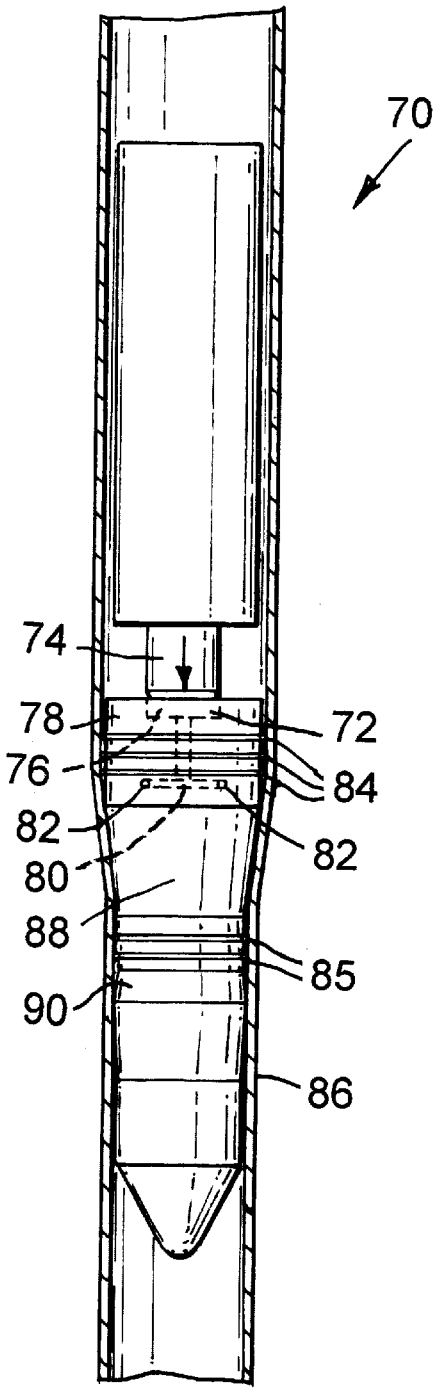
FIG. 3 is a schematic illustration of tubing expansion apparatus in accordance with a third embodiment of the present invention.

Reference is now made to FIG. 3 of the drawings which is a schematic illustration of tubing expansion apparatus 70 in accordance with a third embodiment of the present invention. The apparatus 70 is generally similar to the apparatus 50 described above, and additionally includes an arrangement 72 for providing pressure pulses, timed to coincide with the impulses or impacts produced by the impact hammer 74.

In this example, the hammer 74 impacts on a piston 76 provided in the face of the anvil 78, which piston 76 acts on fluid in a chamber 80 within the anvil 78 such that pressurised fluid exits the chamber 80 via ports 82 with each impact of the hammer 74. Sets of split steel seal rings 84, 85 are provided on the apparatus 70 below and above the ports 82, and are adapted to provide a sliding seal with the unexpanded casing 86 ahead of the expansion cone 88 and the expanded casing behind the cone 88, respectively. Thus, in addition to the standing elevated hydraulic pressure, held by the seal 90 at the leading end of the apparatus, the portion of the casing 86 to be expanded will experience additional pressure pulses, which further facilitate expansion of the casing 86.

The additional hydraulic expansion forces experienced by the casing 86 act to reduce the proportion of the expansion force that would otherwise have to be produced mechanically by the cone 88.

It will be apparent to those of skill in the art that the above-described embodiments are merely exemplary of the present invention and that various modifications and improvements may be made thereto without departing from the scope of the invention.

We claim:

1. A method of expanding tubing, the method comprising the steps:

locating an expansion tool in a length of expandable tubing of a first diameter; and applying a plurality of impulses to the tool to drive the tool through the tubing and expand the tubing to a larger second diameter.

2. The method of claim 1, wherein the expansion is carried out downhole.

3. The method of claim 1, wherein the impulses are produced, at least in part, hydraulically.

4. The method of claim 3, wherein the impulses are produced by pumping fluid through a variable flow restriction, such that the variation in flow through the restriction induces a variation in fluid pressure.

5. The method of claim 1, wherein the impulses are produced by a hydraulic hammer.

6. The method of claim 1, wherein the impulses are produced, at least in part, by a reciprocating mass impacting on the expansion tool.

7. The method of claim 1, further comprising providing a length of expandable tubing of said first diameter.

8. The method of claim 1, wherein the expandable tubing comprises solid-walled tubing.

9. The method of claim 1, wherein the expandable tubing comprises slotted tubing.

10. The method of claim 1, wherein the impulses are produced using energy supplied via a rotating shaft.

11. The method of claim 10, wherein the rotating shaft is driven from surface.

12. The method of claim 10, wherein the rotating shaft is driven by a downhole motor.

13. The method of claim 1, wherein the impulses are produced, at least in part, by electrical actuation.

14. The method of claim 1, wherein the expansion tool is mounted on a reelable support.

15. The method of claim 1, wherein the expansion tool is advanced through the tubing by a downhole tractor.

16. The method of claim 1, wherein a further expansion tool providing a further degree of expansion to a larger third diameter follows the expansion tool through the tubing.

17. The method of claim 16, wherein the further expansion tool utilises a different expansion mechanism.

18. The method of claim 1, wherein the impulses are applied to the expansion tool with a frequency of at least one cycle per second.

19. The method of claim 18, wherein the impulses are applied to the expansion tool with a frequency between 10 and 50 Hz.

20. The method of claim 1, further comprising applying elevated fluid pressure to the interior of the tubing in the region of the expansion tool.

21. The method of claim 20, wherein the fluid pressure is selected to produce a tubing expansion force approaching the yield strength of the tubing.

22. The method of claim 20, wherein the elevated pressure is provided at a substantially constant level.

23. The method of claim 20, wherein the elevated pressure is provided in the form of pulses, timed to coincide with the impulses to the expansion tool.

24. Tubing expansion apparatus comprising:

a first expansion tool for advancement through a length of expandable tubing to expand the tubing from a smaller first diameter to a larger second diameter; and means for transmitting an impulse force to the tool.

25. The apparatus of claim 24, wherein the means for transmitting an impulse force to the tool comprises an anvil.

26. The apparatus of claim 24, wherein the expansion tool comprises an expansion member and a seal located forward of the expansion member.

27. The apparatus of claim 26, wherein the seal describes a diameter corresponding to said smaller first diameter.

28. The apparatus of claim 24, further comprising a fluid pulse generator.

29. The apparatus of claim 28, wherein the fluid pulse generator is adapted to create a fluid pulse in concert with an impulse force applied to the expansion tool.

30. The apparatus of claim 29, further comprising axially spaced seals and wherein the fluid pulse generator includes a fluid outlet located between the seals.

31. The apparatus of claim 30, wherein one seal describes a diameter corresponding to the first diameter and another seal describes a diameter corresponding to the second diameter.

32. The apparatus of claim 24, further comprising means for producing impulses.

33. The apparatus of claim 32, comprising means for producing impulses hydraulically.

34. The apparatus of claim 33, wherein said means for producing impulses hydraulically includes a variable flow restriction, such that the variation in flow through the restriction induces a variation in fluid pressure.

35. The apparatus of claim 33, wherein said means for producing impulses hydraulically comprises a hydraulic hammer.

36. The apparatus of claim 24, further comprising an expansion cone and at least one weight sub.

37. The apparatus of claim 24, further comprising a reciprocating mass, the mass being arranged to impact on the expansion tool.

38. The apparatus of claim 37, wherein the mass is spring-mounted.

39. The apparatus of claim 38, wherein the spring tends to bias the mass towards the expansion tool.

40. The apparatus of claim 37, further comprising a rotating shaft linked to the mass.

41. The apparatus of claim 40, wherein the rotating shaft is coupled to the reciprocating mass via a cam arrangement.

42. The apparatus of claim 40, wherein the mass is restrained against rotation relative to the shaft by coupling to the expansion tool.

43. The apparatus of claim 24, further comprising a downhole motor.

44. The apparatus of claim 24, further comprising electrically actuated means for producing impulses.

45. The apparatus of claim 24, further comprising magnetically actuated means for producing impulses.

46. The apparatus of claim 24, in combination with a reelable support.

47. The apparatus of claim 24, in combination with a downhole tractor.

48. The apparatus of claim 24, wherein the expansion tool comprises an expansion cone.

49. The apparatus of claim 24, in combination with a further expansion tool.

50. The apparatus of claim 49, wherein the further expansion tool utilises a different expansion mechanism from said first expansion tool.

51. The apparatus of claim 49, wherein the further expansion tool is adapted to provide a further degree of expansion.

52. The apparatus of claim 51, wherein the further expansion tool is a rolling element expansion tool.

53. The apparatus of claim 24, further comprising ratchet means for retaining advancement of the expansion tool through the tubing between impulses.

54. The apparatus of claim 24, wherein the apparatus defines a throughbore to permit communication therethrough.

* * * * *